US008518241B2

(12) United States Patent
Petri et al.

(10) Patent No.: US 8,518,241 B2
(45) **Date of Patent: *Aug. 27, 2013**

(54) METHOD FOR MULTI-STAGED HYDROPROCESSING

(75) Inventors: John A. Petri, Palatine, IL (US); Vedula K. Murty, Willowbrook, IL (US); Peter Kokayeff, Naperville, IL (US)

(73) Assignee: UOP LLC, Des Plaines, IL (US)

( * ) Notice: Subject to any disclaimer, the term of this patent is extended or adjusted under 35 U.S.C. 154(b) by 893 days.

This patent is subject to a terminal disclaimer.

(21) Appl. No.: 12/495,574

(22) Filed: Jun. 30, 2009

(65) Prior Publication Data

US 2010/0326884 A1 Dec. 30, 2010

(51) Int. Cl.
*C10G 65/12* (2006.01)
*C10G 69/02* (2006.01)

(52) U.S. Cl.
USPC ..... 208/89; 208/58; 208/59

(58) Field of Classification Search
USPC ..... 208/57, 58, 59, 89
See application file for complete search history.

(56) References Cited

U.S. PATENT DOCUMENTS 2,578,704 A 12/1951 Houdry
2,878,179 A 3/1959 Hennig
2,943,999 A 7/1960 Moore
3,072,465 A 1/1963 Benichou et al.
3,128,242 A 4/1964 Bergstrom et al.

(Continued)

FOREIGN PATENT DOCUMENTS

EP 0225053 A1 10/1987
EP 1394237 A1 3/2004

(Continued)

OTHER PUBLICATIONS

Green, Perry's Chemical Engineers' Handbook, 8th Edition, 2008, McGraw-Hill. Online version available at: http://www.knovel.com/web/portal/browse/display?_EXT_KNOVEL_DISPLAY_bookid=22038,VerticalID=0.

(Continued)

*Primary Examiner* — Walter D Griffin
*Assistant Examiner* — Renee E Robinson
(74) *Attorney, Agent, or Firm* — James C. Paschall

(57) ABSTRACT

Methods for processing a hydrocarbonaceous feedstock flows are provided. In one aspect, the method includes providing two or more hydroprocessing stages disposed in sequence, each hydroprocessing stage having a hydroprocessing reaction zone with a hydrogen requirement and each stage in fluid communication with the preceding stage. A hydrogen source is provided substantially free of hydrogen from a hydrogen recycle compressor. The hydrocarbonaceous feedstock flow is separated into an portions of fresh feed for each hydroprocessing stage, and the first portion of fresh feed to the first hydroprocessing stage is heated. The heated first portion of fresh feed is supplied with hydrogen from the hydrogen source in an amount satisfying substantially all of the hydrogen requirements of the hydroprocessing stages to a first hydroprocessing zone. The unheated second portion of fresh feed is admixed with effluent from previous stage to quench the hot reactor effluent before entering a second stage.

18 Claims, 1 Drawing Sheet

(56) References Cited

U.S. PATENT DOCUMENTS

| | | | | |
|---|---|---|---|---|
| 3,130,006 | A | | 4/1964 | Rabo et al. |
| 3,130,145 | A | | 4/1964 | Buckhannan |
| 3,142,545 | A | | 7/1964 | Raarup et al. |
| 3,154,481 | A | | 10/1964 | Brooks |
| 3,328,290 | A | | 6/1967 | Hengstebeck |
| 3,592,757 | A | | 7/1971 | Baral |
| 3,623,974 | A | | 11/1971 | Mounce et al. |
| 3,668,112 | A | | 6/1972 | Parker et al. |
| 3,720,602 | A | | 3/1973 | Riley et al. |
| 3,730,880 | A | | 5/1973 | Van der Toorn et al. |
| 3,981,793 | A | | 9/1976 | Christie et al. |
| 4,218,338 | A | | 8/1980 | Huin et al. |
| 4,363,718 | A | | 12/1982 | Klotz |
| 4,419,220 | A | | 12/1983 | LaPierre et al. |
| 4,501,926 | A | | 2/1985 | LaPierre et al. |
| 4,554,065 | A | | 11/1985 | Albinson et al. |
| 4,555,325 | A | | 11/1985 | Wolowski et al. |
| 4,676,887 | A | | 6/1987 | Fischer et al. |
| 4,678,764 | A | | 7/1987 | Le et al. |
| 4,683,214 | A | | 7/1987 | Angevine et al. |
| 4,689,138 | A | | 8/1987 | Miller |
| 4,735,780 | A | | 4/1988 | Noe |
| 4,738,766 | A | | 4/1988 | Fischer et al. |
| 4,746,495 | A | | 5/1988 | Mingaud et al. |
| 4,750,357 | A | | 6/1988 | Anderson et al. |
| 4,788,378 | A | | 11/1988 | Chang et al. |
| 4,789,457 | A | | 12/1988 | Fischer et al. |
| 4,828,677 | A | | 5/1989 | Fischer et al. |
| 4,855,530 | A | | 8/1989 | LaPierre et al. |
| 4,859,311 | A | | 8/1989 | Miller |
| 4,867,862 | A | | 9/1989 | Ziemer |
| 4,919,789 | A | | 4/1990 | Fischer et al. |
| 4,921,594 | A | | 5/1990 | Miller |
| 4,943,366 | A | | 7/1990 | Fischer et al. |
| 4,954,241 | A | | 9/1990 | Kukes et al. |
| 4,960,504 | A | | 10/1990 | Pellet et al. |
| 4,962,269 | A | | 10/1990 | LaPierre et al. |
| 5,082,986 | A | | 1/1992 | Miller |
| 5,114,562 | A | | 5/1992 | Haun et al. |
| 5,135,638 | A | | 8/1992 | Miller |
| 5,149,421 | A | | 9/1992 | Miller |
| 5,246,566 | A | | 9/1993 | Miller |
| 5,282,958 | A | | 2/1994 | Santilli et al. |
| 5,290,427 | A | | 3/1994 | Fletcher et al. |
| 5,403,469 | A | | 4/1995 | Vauk et al. |
| 5,403,470 | A | | 4/1995 | Kokayeff et al. |
| 5,447,621 | A | | 9/1995 | Hunter |
| 5,527,448 | A | | 6/1996 | Morel et al. |
| 5,718,820 | A | | 2/1998 | Morel et al. |
| 5,720,872 | A | | 2/1998 | Gupta |
| 5,833,837 | A | | 11/1998 | Miller |
| 5,877,350 | A | | 3/1999 | Langer et al. |
| 5,904,835 | A | | 5/1999 | Thakkar |
| 5,976,351 | A | | 11/1999 | Apelian et al. |
| 5,980,729 | A | | 11/1999 | Kalnes et al. |
| 6,036,844 | A | | 3/2000 | Gupta et al. |
| 6,106,694 | A | | 8/2000 | Kalnes et al. |
| 6,106,695 | A | * | 8/2000 | Kalnes et al. ..... 208/59 |
| 6,123,835 | A | | 9/2000 | Ackerson et al. |
| 6,200,462 | B1 | | 3/2001 | Cash et al. |
| 6,217,746 | B1 | | 4/2001 | Thakkar et al. |
| 6,221,239 | B1 | | 4/2001 | Morel et al. |
| 6,294,080 | B1 | | 9/2001 | Thakkar et al. |
| 6,299,759 | B1 | | 10/2001 | Bradway et al. |
| 6,387,245 | B1 | | 5/2002 | Kalnes et al. |
| 6,402,935 | B1 | | 6/2002 | Kalnes |
| 6,428,686 | B1 | | 8/2002 | Ackerson et al. |
| 6,444,116 | B1 | | 9/2002 | Galiasso et al. |
| 6,497,810 | B1 | | 12/2002 | Laccino et al. |
| 6,497,813 | B2 | | 12/2002 | Ackerson et al. |
| 6,627,778 | B2 | | 9/2003 | Xu et al. |
| 6,638,419 | B1 | | 10/2003 | Da Silva et al. |
| 6,645,371 | B2 | | 11/2003 | Vuillemot et al. |
| 6,656,342 | B2 | | 12/2003 | Smith et al. |
| 6,689,273 | B1 | | 2/2004 | Kalnes et al. |
| 6,702,935 | B2 | | 3/2004 | Cash et al. |
| 6,881,326 | B2 | | 4/2005 | Ackerson et al. |
| 6,890,425 | B2 | | 5/2005 | Ackerson et al. |
| 6,929,738 | B1 | | 8/2005 | Riley et al. |
| 7,041,211 | B2 | | 5/2006 | Kalnes |
| 7,074,320 | B2 | | 7/2006 | Miller |
| 7,078,439 | B2 | | 7/2006 | Odueyungbo et al. |
| 7,094,332 | B1 | | 8/2006 | Kalnes et al. |
| 7,097,815 | B2 | | 8/2006 | Dassori et al. |
| 7,156,977 | B2 | | 1/2007 | Wrisberg et al. |
| 7,238,277 | B2 | | 7/2007 | Dahlberg et al. |
| 7,354,462 | B2 | | 4/2008 | O'Rear |
| 8,008,534 | B2 | | 8/2011 | Petri et al. |
| 2002/0004621 | A1 | | 1/2002 | Xu et al. |
| 2002/0148755 | A1 | | 10/2002 | Ackerson et al. |
| 2004/0159582 | A1 | | 8/2004 | Simmons et al. |
| 2005/0010076 | A1 | | 1/2005 | Wasserscheid et al. |
| 2005/0082202 | A1 | | 4/2005 | Ackerson et al. |
| 2006/0118464 | A1 | | 6/2006 | Kalnes |
| 2006/0144756 | A1 | | 7/2006 | Ackerson et al. |
| 2008/0023372 | A1 | | 1/2008 | Leonard et al. |
| 2008/0159928 | A1 | | 7/2008 | Kokayeff et al. |
| 2009/0095651 | A1 | | 4/2009 | Leonard et al. |
| 2009/0095652 | A1 | | 4/2009 | Kokayeff et al. |
| 2009/0095653 | A1 | | 4/2009 | Kokayeff et al. |
| 2009/0095655 | A1 | | 4/2009 | Kokayeff et al. |
| 2009/0095656 | A1 | | 4/2009 | Kokayeff et al. |
| 2009/0321310 | A1 | | 12/2009 | Kokayeff et al. |
| 2009/0321319 | A1 | | 12/2009 | Kokayeff et al. |
| 2009/0326289 | A1 | | 12/2009 | Petri et al. |
| 2010/0155294 | A1 | | 6/2010 | Kokayeff et al. |

FOREIGN PATENT DOCUMENTS

| | | | |
|---|---|---|---|
| EP | 0993498 | B1 | 8/2004 |
| WO | 9613563 | A1 | 5/1996 |
| WO | 9626993 | A1 | 9/1996 |
| WO | 0034416 | A1 | 6/2000 |

OTHER PUBLICATIONS

U.S. Appl. No. 11/300,007, filed Dec. 14, 2005, Leonard.

U.S. Appl. No. 12/495,601, filed Jun. 30, 2009, Petri.

Office Action dated Jun. 4, 2009 in U.S. Appl. No. 11/460,307, Leonard.

Applicants' Sep. 4, 2009 Response to the Jun. 4, 2009 Office Action in U.S. Appl. No. 11/460,307, Leonard.

Office Action dated Jun. 12, 2009 in U.S. Appl. No. 11/618,623, Kokayeff.

Applicants' Sep. 11, 2009 Response to the Jun. 12, 2009 Office Action in U.S. Appl. No. 11/618,623, Kokayeff.

Office Action dated Dec. 15, 2009 in U.S. Appl. No. 11/872,084, Leonard.

Applicants' Mar. 15, 2010 Response to the Dec. 15, 2009 Office Action in U.S. Appl. No. 11/872,084, Leonard.

Office Action dated Oct. 5, 2009 in U.S. Appl. No. 11/872,312, Kokayeff.

Applicants' Jan. 5, 2010 Response to the Oct. 5, 2009 Office Action in U.S. Appl. No. 11/872,312, Kokayeff.

Office Action dated Apr. 12, 2010 in U.S. Appl. No. 11/872,312, Kokayeff.

Applicants' Jul. 1, 2010 Response to the Apr. 12, 2010 Office Action in U.S. Appl. No. 11/872,312, Kokayeff.

Ronze, "Hydrogen solubility in straight run gasoil", Chemical Engineering Science 57 (2002) 547-553.

Wache, "Improved deep desulphurisation of middle distillates by a two-phase reactor with pre-saturator", Fuel 85 (2006) 1483-1493.

Boesmann, "Deep desulfurization of diesel fuel by extraction with ionic liquids", Chem. Commun., 2001, 2494-2495.

Datsevitch, "Improvement of the Deep Desulphurization of Diesel Oil by Pre-saturation and a Recycle of the Liquid Phase", DGMK Tagungsbericht, 2003, pp. 321-328, Chemical Abstracts 140(15/16), Abstract No. 255917 (2004).

Gatte, "Hydrogen Processing. Hydrotreating. General Process", National Petrochemical and Refiners Association, 1999 NPRA Question and Answer Session on Refining and Petrochemical Technology, Washington, DC, pp. 140-158.
Gudde, "Improving deep sulfur removal from motor fuels by the use of a pre-saturator and a liquid circuit", Chemie-Ingenieur-Technik 75(8) 2003, p. 1040, and English language abstract.
Johnson, "Weigh Options for Meeting Future Gasoline Sulfur Specifications", Harts' Fuel Techology & Management, vol. 7, No. 2, pp. 16,18 (Mar. 1997).
Schmitz, "Deep desulfurization of diesel oil: kinetic studies and process-improvement by the use of a two-phase reactor with pre-saturator", Chemical Engineering Science 59 (2004) 2821-2829.
Stratiev, "Investigation on the Effect of Heavy Diesel Fraction Properties on Product Sulphur during Ultra Deep Diesel Hydrodesulphurization", Erdol Erdgas Kohle, vol. 122, No. 2, 2006, pp. 59-60, 62-63, Urban Verlag Hamburg/Wien GmbH, Germany.

* cited by examiner

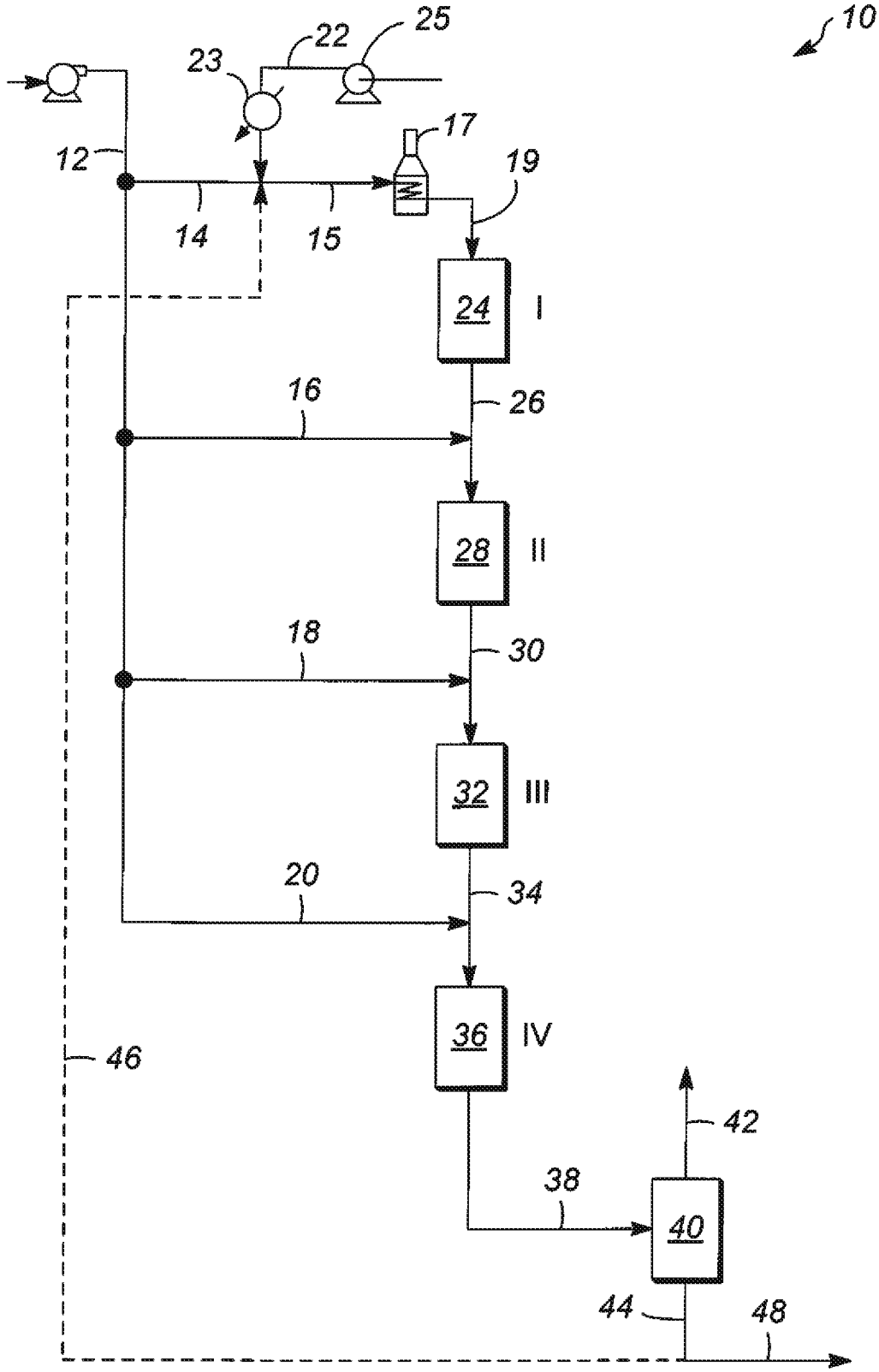
10
12
14
15
16
17
18
19
20
22
23
24
I
25
26
28
II
30
32
III
34
36
IV
38
40
42
44
46
48

METHOD FOR MULTI-STAGED HYDROPROCESSING

FIELD OF THE INVENTION

The field generally relates to hydroprocessing of hydrocarbon streams and, more particularly, to hydroprocessing using multiple hydroprocessing stages.

BACKGROUND OF THE INVENTION

Petroleum refiners often produce desirable products such as turbine fuel, diesel fuel, middle distillates, naphtha, and gasoline, among others, by hydroprocessing a hydrocarbonaceous feedstock derived from crude oil or heavy fractions thereof. Hydroprocessing can include, for example, hydrocracking, hydrotreating, hydrodesulphurization and the like. Feedstocks subjected to hydroprocessing may include vacuum gas oils, heavy gas oils, and other hydrocarbon streams recovered from crude oil by distillation. For example, a typical heavy gas oil comprises a substantial portion of hydrocarbon components boiling above about 37° C. (700° F.) and usually at least about 50 percent by weight boiling above 371° C. (700° F.), and a typical vacuum gas oil normally has a boiling point range between about 315° C. (600° F.) and about 565° C. (1050° F.).

Hydroprocessing concerns reacting the feedstock in the presence of a hydrogen-containing gas with suitable catalyst(s) to convert constituents of the feedstocks to other forms, to extract contaminants from feedstock, etc. In many instances, hydroprocessing is accomplished by contacting the selected feedstock in a reaction vessel or zone with the suitable catalyst under conditions of elevated temperature and pressure in the presence of hydrogen as a separate phase in a substantially three-phase system (i.e., hydrogen gas, a substantially liquid hydrocarbon stream, and a solid catalyst). Such hydroprocessing apparatuses are commonly undertaken in a trickle-bed reactor where the continuous phase throughout the reactor is gaseous.

In such trickle-bed reactors, a substantial excess of the hydrogen gas is present in the reactor to form the continuous gaseous phase. In many instances, a typical trickle-bed hydrocracking reactor requires up to about 1685 $Nm^3/m^3$ (10,000 SCF/B of hydrogen at pressures up to 17.3 MPa (2500 psig) to effect the desired reactions. In these apparatuses, because the continuous phase throughout the reactor is the gas-phase, large amounts of excess hydrogen gas are generally required to maintain this continuous phase throughout the reactor vessel. However, supplying such large supplies of gaseous hydrogen at the operating conditions needed for hydroprocessing adds complexity and capital and operating expense to the hydroprocessing apparatus.

Typically, in order to supply and maintain the needed amounts of hydrogen in a continuous gas-phase system, the effluent from a reactor circuit, such as the trickle-bed reactor, is subject to separation into a gaseous component containing hydrogen and a liquid component. A hydrogen recycle gas compressor is used to recirculate the separated hydrogen back to the reactor circuit inlet to assist in supplying the large amounts of hydrogen gas needed to maintain the reactor's continuous gaseous phase. The recycle gas compressor commonly recirculates hydrogen within the hydroprocessing unit in amounts significantly in excess of the hydrogen used by the reactor circuit due to chemical hydrogen consumption. The recycle gas compressor is distinct from a make-up gas compressor which supplies hydrogen to the unit from the general refinery hydrogen supply.

For example, conventional trickle-bed hydroprocessing units typically operate up to about 17.3 MPa (2500 psig) and, therefore, require the use of a high-pressure recycle gas compressor in order to provide the recycled hydrogen at necessary volumes and elevated pressures. Often such hydrogen recycle can be up to about 1685 $Nm^3/m^3$ (10,000 SCF/B, and processing such quantities of hydrogen through a high-pressure compressor adds complexity, increased capital costs, and increased operating costs to the hydroprocessing unit. In general, the recycle gas apparatus may represent as much as about 15 to about 30 percent of the cost of a hydroprocessing unit.

In order to eliminate the costly recycle gas compressor, it has been proposed to utilize a two-phase system using a liquid recycle of the processed product stream back through the hydroprocessing units. The recycled product is essentially inert and can act as diluent for the fresh feed and as a hydrogen carrier. Such systems, however, require large volumes of product to provide the desired ratios of the recycled product to the untreated feed. Maintaining such large ratios of recycled product to untreated feed presents difficulty in the design for larger hydroprocessing units. In many instances, the combined recycled product and untreated feed flow could exceed a single train capacity limit of the unit. Thus such units impose additional expense for large capacity recycle pumps and similar apparatuses, as well as related operational issues to permit such large volumetric flows.

While two-phase systems can operate without a costly recycle gas compressor, the reactions in such two-phase systems are generally less efficient, with less contact time between the unconverted oil and the catalyst than similar reactions in the more common substantially three-phase systems. For example, with a given amount of catalyst, the contact time of the unconverted oil in the feed with the catalyst in the substantially three-phase system is significantly greater than the contact time of the unconverted oil with catalyst in the liquid-phase system. Generally due to the diluents in the feed of the liquid-phase systems, the contact time of the unconverted oil with the catalyst is reduced considerably because so much of the feed is diluent. As a result, the reaction rates in the liquid-phase systems are less efficient and reduced from those in a substantially three-phase system with a similar amount of catalyst.

SUMMARY OF THE INVENTION

Methods for hydroprocessing a hydrocarbonaceous feedstock are provided that utilize staged hydroprocessing reaction zones to sequentially treat the hydrocarbonaceous feed. The feed is generally divided into portions, and an initial portion is heated and directed to a first hydroprocessing reaction zone. A second feed portion is not heated and is mixed with the effluent from the first hydroprocessing reaction zone to quench it. The mixture is then supplied to a second hydroprocessing reaction zone. Additional portions of the feed may be processed in subsequent hydroprocessing reaction zones in a similar manner. In one aspect, a source of hydrogen, such as hydrogen from a make-up gas compressor, is supplied to the hydrocarbonaceous feed to the first hydroprocessing reaction zone in an amount sufficient to provide the hydrogen requirements for the first hydroprocessing zone and each of the subsequent hydroprocessing reaction zones. In an aspect, the hydrogen flow rate to the first hydroprocessing reaction zone includes sufficient hydrogen to maintain a hydrogen atmosphere in excess of the chemical hydrogen requirements. In this way, a vapor phase is maintained through all the reaction zones.

In this aspect, the hydrogen for each hydroprocessing reaction zone is carried in the heated reactor charge to the first reaction zone. The feed for the second and subsequent zones comprises the treated effluent from the preceding reaction zone, which acts as a diluent and hydrogen source. The feed for the second and subsequent zones also comprises a portion of the unheated, untreated feed supplied for hydroprocessing in the second and perhaps subsequent reaction zones which act as a quench to control the reaction zone charge temperature. In one such aspect, the ratio of the untreated feed to treated effluent is less than 1, and in other aspects, no more than 0.5 and preferably no more than 0.2. Accordingly, a substantial amount of hydrogen can be carried by the process flow to each hydroprocessing reaction zone from the previous hydrotreatment zone to provide the hydrogen requirements for that reaction zone.

In another such aspect, the hydrogen content of the process flow is sufficient to maintain a substantially three-phase hydroprocessing zone (hydrogen gas phase, the liquid process flow and the solid catalyst) in at least the initial reaction zone. As hydrogen is consumed in each subsequent reaction zone, the hydrogen content of the process stream continuously decreases, such that one or more of the subsequent reaction zones may be substantially liquid-phase reaction zones throughout. However, a portion of hydrogen in excess of the overall chemical hydrogen consumption is provided to maintain a vapor phase at the outlet of the last reaction zone. In each such aspect, it is unnecessary to utilize a recycle gas compressor to supply the required hydrogen to each reaction zone, thus realizing significant capital cost savings and operational efficiencies of the apparatus.

In still another aspect, a multi-stage hydroprocessing method and apparatus is provided that utilizes sequential hydroprocessing reaction zones as generally discussed above. In such aspects, the temperature of the process flow as it passes over the catalyst in one or more of the reaction zones increases due to the exothermal nature of reactions in the zone. The heated effluent from each such reaction zone may be mixed with the unheated fresh feed designated for the next downstream hydroprocessing reaction zone, which is at a lower temperature than the effluent. Thus, the fresh feed may be used to quench the temperature of the combined process flow into the subsequent reaction zones. In this aspect, accordingly, the temperature of the fresh feed, distribution of catalyst in each zone, as well as the distribution of the fresh feed flow to each zone, may be selected such that the temperature of the combined process flow is within the range required for the efficient operation of all of the hydroprocessing reaction zones.

As with the method and apparatus above, hydrogen is added only at the beginning of the process in an amount effective to provide sufficient hydrogen for each of the hydroprocessing reactor zones and an additional quantity of hydrogen to minimally maintain the reactor effluent in two phases. When this hydrogen is added at the beginning of the process, the portion of the fresh feed to the first reaction zone ensures that the reaction zone is a substantially three-phase reaction zone. The hydrogen in the process stream is consumed in each reaction zone, and therefore subsequent reactions zones may be substantially liquid-phase reaction zones. Such reaction zones are in a substantially liquid phase throughout. Thus, these aspects also virtually eliminate the need for hydrogen recycle gas compressors and the accompanying cost and other inefficiencies.

In another aspect, the ratio of the treated effluent to the untreated fresh feed for each reaction stage may be significant and may be different for different reaction stages, for example, the ratios may be 3 to 1, 5 to 1 or 10 to 1 or greater, depending on the needs of the particular reaction stage. These ratios can be obtained as only a portion of the feedstock is introduced at each reaction stage, and the treated effluent, which acts as a diluent and hydrogen carrier, is provided from the preceding reaction stage. Thus, the methods and apparatus herein provide high ratios of treated effluent to untreated feed without correspondingly high externally recycled product volumes. Thus, relatively high overall liquid process flow volumes, or the need for high volume, high capacity recycle pumps and related apparatuses may be avoided. In one such aspect, the hydrogen requirement may be obtained from an external source, such as a make-up gas compressor. The make-up hydrogen flow may be supplied directly to the substantially three-phase hydroprocessing zone and is supplied in an amount sufficient to satisfy the requirements of the substantially three-phase reaction zone. The make-up hydrogen flow also provides excess hydrogen in an amount sufficient to satisfy the requirements of the subsequent substantially liquid-phase hydroprocessing zones.

Accordingly, the methods and apparatus satisfy the hydrogen requirements of the reaction zones without using a hydrogen recycle gas compressor. They further reduce or eliminate the need for heat exchangers, recycled liquid or gas quench streams, or other temperature control devices between or in the process flow path. Indeed, the methods and apparatus use the unheated feed as quench to the second and perhaps each subsequent reaction zone after the first reaction zone to moderate the temperature of the process stream through all of the reaction zones. As a result, considerable cost savings and operational efficiencies may be achieved by reducing or eliminating the need for heat exchangers in the reaction zones, and the accompanying maintenance difficulties and expense.

Other embodiments encompass further details of the process, such as preferred feedstocks, catalysts, and operating conditions to provide but a few examples. Such other embodiments and details are hereinafter disclosed in the following discussion of various aspects of the process.

BRIEF DESCRIPTION OF THE DRAWING

The FIGURE is one exemplary flow scheme of a hydroprocessing method.

DETAILED DESCRIPTION

The methods described herein are particularly useful for hydroprocessing a hydrocarbonaceous feedstock containing hydrocarbons, and typically other organic materials, to produce a product containing hydrocarbons or other organic materials of lower average boiling point, lower average molecular weight, as well as reduced concentrations of contaminants, such as sulfur and nitrogen and the like. In one aspect, the present hydroprocessing methods provide methods and apparatus for the sequential treatment of a feedstock utilizing multiple reaction zones, which may utilize a combination of sequential addition of feedstock to the process flow, a combination of substantially three-phase hydroprocessing reaction zones and substantially liquid phase reaction zones. The methods and apparatuses also utilize an initial hydrogen addition that provides all the hydrogen requirements for each of the reaction zones without the use of hydrogen sourced from a hydrogen recycle gas compressor. In other words, the hydrogen is not recycled within the hydroprocessing unit, but is supplied from outside the hydroprocessing unit. Consequently, the source of hydrogen is out of downstream communication with hydroprocessing reaction stages except perhaps through a make-up gas compressor. which is sourced from refinery wide hydrogen supply as opposed to a recycle gas compressor which would be within the hydroprocessing unit of the refinery. Some hydrogen excess from the hydroprocessing unit may be routed to the refinery-wide hydrogen supply. Accordingly, the hydrogen source is out of downstream communication with the hydroprocessing reaction zones but optionally through a make-up gas compressor. As used herein, the term "communication" means that material flow is operatively permitted between enumerated components. The term "downstream communication" means that at least a portion of material flowing to the component in downstream communication may operatively flow from the component with which it communicates. The term "upstream communication" means that at least a portion of the material flowing from the component in upstream communication may operatively flow to the component with which it communicates.

The methods and apparatus provide for a simplified approach to providing the hydrogen requirements of the reaction zones utilizing, in one aspect, hydrogen addition before the first reaction zone that is sufficient to supply hydrogen for each of the subsequent reaction zones plus an additional quantity of hydrogen to minimally maintain the reactor effluent in two-phases. The methods and apparatus do not require the use of high volume externally recycled liquid streams and the pumps and apparatuses necessary to provide such recycle streams. In yet other aspects, the methods and apparatus provide for the control of the temperature of the process flow into and through each reaction zone using the sequentially added fresh feedstock flow.

In other aspects, the use of both substantially three-phase and substantially liquid-phase reaction zones provides the flexibility to subject the process flow to different hydroprocessing reactions, such as hydrotreatment and hydrocracking, as well as the order of such hydroprocessing reactions in the process sequence. Thus, the methods and apparatuses provide significant flexibility in the processing of the feedstock.

The hydrocarbonaceous feedstocks that may be processed using the methods and apparatuses comprise mineral oils and synthetic oils (e.g., shale oil, tar sand products, etc.) and fractions thereof that may be subjected to hydroprocessing and hydrocracking. Illustrative hydrocarbon feedstocks include those containing components boiling above about 150° C. (300° F.), such as atmospheric gas oils, vacuum gas oils, deasphalted, vacuum, and atmospheric residua, hydrotreated or mildly hydrocracked residual oils, coker distillates, straight run distillates, solvent-deasphalted oils, pyrolysis-derived oils, high boiling synthetic oils, cycle oils, catalytic cracker distillates, and Fischer-Tropsch derived liquids. One preferred feedstock is a gas oil or other hydrocarbon fraction having at least about 50 wt-%, and preferably at least about 75 wt-%, of its components boiling at a temperature above about 371° C. (700° F.). For example, another preferred feedstock contains hydrocarbon components which boil above about 288° C. (550° F.) with at least about 25 percent by volume of the components boiling between about 315° C. (600° F.) and about 565° C. (1050° F.). Other suitable feedstocks may have a greater or lesser proportion of components boiling in such range.

The substantially liquid hydrocarbonaceous feedstock is subjected to the sequential, staged treatment in two or more hydroprocessing reaction zones. In one aspect, the feedstock is separated to provide feed streams for each reaction zone. The feed rate for each such fresh feed stream is selected based on the composition of the hydrocarbonaceous feedstock, the desired hydroprocessing treatment, and the requirements for each reaction zone. The feed rates for each such fresh feed stream may be the same or they may vary from reaction zone to reaction zone, depending on the needs of the process and apparatus.

Each of the hydroprocessing reaction zones has a hydrogen requirement, and these hydrogen requirements will differ depending on the type of hydroprocessing carried out in the zone. For example, substantially three-phase reactors typically utilize a substantially continuous gaseous phase. The three-phase environment will provide a more kinetically favorable environment for conversion of the hydrocarbonaceous oil and, therefore, may have greater hydrogen requirement. In other aspects, a hydroprocessing zone may be a substantially liquid-phase zone, with a substantially liquid phase throughout. The substantially liquid-phase hydroprocessing zones generally contain a relatively limited hydrogen flow. In other substantially three-phase reaction zones, the gaseous phase may not be continuous, and in other substantially liquid-phase reaction zones the substantially liquid phase may not be continuous.

In some aspects, the fresh feedstock does not contain recycled product from the hydroprocessing zones. In other aspects, a recycle stream may be incorporated in to the fresh feedstock prior to hydroprocessing the feedstock to provide additional volume to the process zone to provide added hydrogen-carrying capacity to the product stream. In such aspects, any recycled product typically is introduced into the feedstock before the above mentioned hydrogen stream is mixed with the feedstock, and no further recycled product is incorporated into the process flow. Typically, such recycled product is stripped of a vaporous phase of hydrogen, hydrogen sulfide, nitrogen or nitrogen containing compositions, and any other vapor phase materials. In another aspect, this recycle stream also is supplied and mixed with the above mentioned hydrogen stream before it is introduced to the feedstock.

In one aspect, the fresh feed to the first reaction zone is provided and mixed with a hydrogen flow from a make-up gas compressor or other similar hydrogen sources. The hydrogen flow is mixed into the fresh feed for the first reaction zone and is provided at a rate at least sufficient to satisfy of the hydrogen requirements of the first and subsequent reaction zones. In some instances, the amount of added hydrogen will include an amount in excess of the predicted hydrogen requirements of the apparatus as reserve in event the hydrogen consumption exceeds the expected amount at a particular stage or in the apparatus as a whole.

In other aspects, hydrogen is added to the fresh feed stream to provide sufficient hydrogen for the gas phase in the substantially three-phase reaction zones as well as to provide, and in some aspect, to exceed the saturation point of the liquid process flows so that in any subsequent substantially liquid phase reaction zones there is a small vapor phase throughout the substantially liquid phase. Thus, there is, in some aspects, sufficient additional hydrogen in the small vapor phase to provide additional hydrogen to the liquid phase of the substantially liquid phase reaction zones mentioned below to provide additional dissolved hydrogen in the substantially liquid-phase as the reactions consume hydrogen so that a substantially constant reaction rate throughout the reactor can be achieved. For example, the amount of added hydrogen may be about 10 to 20 wt-% greater than the expected collective hydrogen requirements of each hydroprocessing stage. In one such aspect, the amount of hydrogen is sufficient to supply the three-phase zones and also range from about 120 to about 150 percent of saturation of the substantially liquid phase zones.

In yet other aspects, it is expected that the amount of hydrogen may be up to about 500 percent of saturation to about 1000 percent of the saturated liquid phase zones. The hydrogen is carried in the effluent from each reaction zone in either a dissolved form, a gaseous phase, or both a gaseous phase and in solution in the liquid effluent streams. In this aspect, no other hydrogen is added to the apparatus. In other aspects, supplemental hydrogen may be added to or between reaction zones. It will be appreciated, however, that the amount of hydrogen added to the first reaction zone can vary depending on the feed composition, operating conditions, desired output, and other factors. In other aspects, alternative substantially three-phase reaction zones known to those skilled in the art may be used. The fresh feed to the first reaction zone is subjected to the hydroprocessing treatment provided by that reaction zone. In one such aspect, the hydroprocessing zone is a substantially three-phase, trickle bed reaction zone with a solid phase catalyst bed, a substantially liquid phase hydrocarbonaceous feed and a substantially continuous gaseous phase extending substantially the length of the catalyst bed.

The fresh feed is separated into portions for respective reaction zones. Only the first portion for the first reaction zone is heated to a predetermined temperature before entering the first reaction zone. The first portion of feed may be heated by a heat exchanger or by a fired heater or both. Additionally or alternatively, the hydrogen stream mixed with the first portion may also be heated to bring the first portion of feed to the appropriate temperature. A second portion of feed is not heated, so it bypasses the heaters which may include heat exchangers and fired heaters. The temperature of the first portion of feed is typically is selected to optimize the hydroprocessing reactions in the first reaction zone, in terms of a minimum temperature to provide efficient hydroprocessing reactions over the catalyst bed. The hydroprocessing reactions typically are exothermal and heat the process flow as it proceeds through each reaction zone. Thus, the inlet or entrance temperature to the first reaction zone also may be selected to ensure that the process flow and catalyst bed temperatures do not exceed the maximum temperatures that permit the efficient operation of the catalyst bed and the hydroprocessing reactions. The heat absorbed by the process flow, and the hydrogen that was not consumed in the first reaction zone are carried out of the first reaction zone as the effluent from the reaction zone, with a first reaction zone outlet temperature and outlet hydrogen content.

The effluent from the first or subsequent hydroprocessing reaction zone then is quenched with a second, unheated portion of fresh feedstock to cool the reaction zone effluent, which provides diluent and hydrogen for a second hydroprocessing reaction zone. The second portion of fresh feed, in one aspect, does not include added hydrogen and is at a lower temperature than the first portion of fresh feedstock. Accordingly, the temperature of the second portion of fresh feed, when mixed with the heated effluent from the first reaction zone, will provide a combined effluent and process flow into the second hydroprocessing reaction zone with a temperature reduced from the temperature of the effluent at the outlet of the first or preceding hydroprocessing zone. Thus, one consideration in selecting the amount and flow rate of this second portion of fresh feed is the desired hydrogen content and temperature of the process flow into the second or subsequent hydroprocessing reaction zone.

In one aspect, the ratio of the first reaction zone effluent and the second portion of fresh feed is about 3 to 1 or 5 to 1 or greater, i.e., the effluent flow to the fresh feed flow. In other aspects, the ratio of effluent to fresh feed may be increased or decreased depending on the specific feed, effluent hydrogen content and temperature, and the nature and requirements of the second and subsequent reaction zones. These ratios can be obtained without substantially increasing the overall process flow through the apparatus because only a portion of the feedstock is introduced at each reaction stage, and the treated effluent, which acts as a diluent and hydrogen carrier, is provided from the preceding reaction stage. Thus, the methods and apparatus herein provide high ratios of treated effluent to untreated feed without correspondingly high overall external recycle and overall product flow volumes from reactor circuit separators, fractionation columns or the like. Thus, high volume, high capacity recycle pumps and related apparatuses typically used to supply high volume recycle flows are not necessary.

In at least one aspect, the hydrogen content of the process flow to the second reaction zone, comprising a first effluent and the second portion of fresh feed, is sufficient to supply the entire hydrogen requirement of a second hydroprocessing reaction zone, which in some aspects is also a substantially three-phase reaction zone without a recycle gas compressor.

The effluent from the second reaction zone typically will have an increased temperature due to the exothermal hydroprocessing over the catalyst beds in the second reaction zone. The hydrogen content in the second reaction zone effluent is reduced by the hydrogen consumed in the second reaction zone and exits the zone at a temperature reflecting absorption by the process flow of additional heat from the hydroprocessing reactions. In several aspects, the process flow into the second hydroprocessing reaction zone contains sufficient unreacted hydrogen to operate as a substantially three-phase, trickle bed reaction process. The hydrogen in the process flow typically is sufficient to maintain the required continuous gaseous phase, while providing sufficient hydrogen for hydroprocessing process of that reaction zone.

In an aspect, the heated effluent from the second hydroprocessing zone may be then mixed with a third unheated portion of fresh feed to quench the effluent and to provide the process flow to a third hydroprocessing reaction zone. As with the second portion of fresh feed, the amount and rate of addition will depend on the temperature and hydrogen content of the second effluent. As with the previous stage, the ratio of treated effluent from the second stage to third portion of fresh feed is about 3 to 1 or 5 to 1 or greater. The amount and flow rate of the third portion of fresh feed will provide a process feed to the third reaction zone with sufficient hydrogen for further hydroprocessing, at temperatures within the range desired for the process. In such aspects, the temperature of the process flow will increase as the flow is reacted over the catalyst bed. Thus, as with the second reaction zone, it often is desirable to quench the second effluent to reduce the temperature of the feed into the subsequent reaction zone sufficiently to ensure that the process flow and catalyst bed temperatures do not exceed the maximum temperatures permitting the efficient operation of the catalyst bed(s).

Given the hydrogen consumption of the previous two reaction zones, if the hydrogen content of the process flow in the third reaction zone falls below about the minimum required for substantially three-phase reaction zones, then it may be desirable to use a substantially liquid-phase reaction apparatus for the, e.g., third and subsequent hydroprocessing reaction zones. In one such reaction apparatus, a substantially liquid phase of the process flow extends continuously over the hydroprocessing catalyst bed. Such substantially liquid-phase reaction zones do not require as much hydrogen as the substantially three-phase reaction zones, as the hydrogen is dissolved or suspended in the substantially liquid phase. As with the previous stages, the process flow is passed over the catalyst beds, and the amount of hydrogen consumed and temperature increase of the process flow will depend on the process flow inlet temperature, catalyst and type of hydroprocessing reaction.

In aspects with further hydroprocessing stages, essentially the same steps are repeated as long as there is sufficient hydrogen in the process flow for additional hydroprocessing treatments after further additions of the fresh feed. In one aspect of the method the catalyst systems may be distributed among the reaction zones to provide an increasing catalyst volume and a correspondingly decreasing LHSVRC (liquid volume per hour of reactor charge per volume of catalyst in the reaction zone) with each additional hydroprocessing reaction zone. Such catalyst volume increases may assist in maintaining a desired treatment efficiency as the process flow progresses through the reaction stages tending toward substantially liquid-phase reaction zones, or as the concentration of catalyst activity inhibitors increase in the process flow. The overall temperature of the process flow may increase with each hydroprocessing step to compensate for the increased concentration of inhibitors that may accumulate in the process flow.

The effluent from the last reaction zone is typically sent to a separation zone for removal of excess hydrogen, contaminants, and vapor phase products. In one aspect, the final effluent is sent to a hot separator where the unreacted hydrogen is removed from the process flow, as are hydrogen sulfide, ammonia and other contaminants. In other aspects, the hot separator also extracts vaporous or low boiling point hydrocarbons, which are then routed to fractionators or to other processes.

In one aspect, the separation zone preferably is a high pressure flash vessel, where any vapor formed in the hydroprocessing zones can be separated from a substantially liquid phase. By one approach, the high pressure flash vessel operates at a temperature from about 232° C. (450° F.) to about 468° C. (875° F.), a pressure from about 3.5 MPa (500 psig) to about 16.5 MPa (2400 psig) to separate such streams. This separation zone is configured to separate any vaporous materials (such as gaseous hydrogen, hydrogen sulfide, ammonia, and/or C1 to C4 gaseous hydrocarbons and the like), which can then be directed to a recovery apparatus. In general, any dissolved hydrogen in the separated substantially liquid stream remains dissolved therein at the pressures and temperatures of the separation zone.

As mentioned above, the substantially three-phase hydroprocessing zone used in the methods and apparatus may have a hydrogen requirement that effectively maintains the substantially three-phase hydroprocessing zone with a substantially continuous gas-phase throughout the reaction zone. For example, in some three-phase hydroprocessing zones, the hydrogen requirements may be from about 100 to about 200 $Nm^3/m^3$ (about 600 to about 1200 SCF/B). The substantially three-phase hydroprocessing zone, for example, may be a hydrotreating zone, a hydrocracking zone, or another conversion zone that provides an effluent that contains excess hydrogen due to the operation of the substantially three-phase zone.

In one form, one or more substantially three-phase reaction zones may be, for example, hydrotreating reaction zones operated as a trickle bed reactor without a recycle gas stream or a recycle gas compressor to supply the hydrogen requirement for this reaction zone. In this form, the hydrotreating reactor reduces the concentration of sulfur and nitrogen in the fresh hydrocarbonaceous feed in the presence of suitable catalyst(s) that are primarily active for the removal of heteroatoms, such as sulfur and nitrogen, from the hydrocarbon process flow.

In one such aspect, suitable hydrotreating catalysts are conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. In another aspect, more than one type of hydrotreating catalyst may be used in the same reaction vessel. In such aspect, the Group VIII metal is typically present in an amount ranging from about 2 to about 20 wt-%, preferably from about 4 to about 12 wt-%. The Group VI metal will typically be present in an amount ranging from about 1 to about 25 wt-%, preferably from about 2 to about 25 wt-%.

In another aspect, one or more substantially three-phase reaction zones are, for example, hydrocracking reaction zones, such as a mild hydrocracking zone, which is also operated as a trickle bed reactor and without a recycle gas stream or a recycle gas compressor to supply the hydrogen requirements for the substantially three-phase reaction zone. Depending on the desired output, the hydrocracking zone may contain one or more beds of the same or different catalyst. In one aspect, for example, when the preferred products are middle distillates, the preferred hydrocracking catalysts utilize amorphous bases or low-level zeolite bases combined with one or more Group VIII or Group VIB metal hydrogenating components. In another aspect, when the preferred products are in the gasoline boiling range, the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base.

The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms ($10^{-10}$ meters). It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms ($10^{-10}$ meters), wherein the silica/alumina mole ratio is about 4 to 6. One example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006 B 1.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least about 10 percent, and preferably at least about 20 percent, metal-cation-deficient, based on the initial ion-exchange capacity. In another aspect, a desirable and stable class of zeolites is one wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and about 30 percent by weight may be used. In the case of the noble metals, it is normally preferred to use about 0.05 to about 2 wt-%.

The method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., about 371° C. to about 648° C. (about 700° F. to about 1200° F.) in order to activate the catalyst and decompose ammonium ions. Alternatively, the zeolite component may first be pelleted, followed by the addition of the hydrogenating component and activation by calcining.

The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between about 5 and about 90 wt-%. These diluents may be employed as such or they may contain a minor proportion of an added hydrogenating metal such as a Group VIB and/or Group VIII metal. Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 B1 (Klotz).

By one approach, the hydrocracking conditions may include a temperature from about 232° C. (450° F.) to about 468° C. (875° F.), a pressure from about 3.5 MPa (500 psig) to about 16.5 MPa (2400 psig) and a liquid hourly space velocity (LHSV) from about 0.1 to about 30 $hr^{-1}$. In some aspects, the hydrocracking reaction provides conversion of the hydrocarbons in the process stream to lower boiling products, which may be the conversion of at least about 5 vol-% of the process flow. In other aspects, the per pass conversion in the hydrocracking zone may be in the range from about 15 percent to about 70 percent and, preferably, the per-pass conversion is in the range from about 20 percent to about 60 percent. In such aspects, the processes herein are suitable for the production of naphtha, diesel or any other desired lower boiling hydrocarbons.

In one aspect, the substantially liquid-phase reaction zones used in the methods and apparatuses may be, for example, substantially liquid-phase hydrotreating zones operated under hydrotreating conditions to produce an effluent including hydrogen sulfide and ammonia. In this aspect, the substantially liquid-phase hydrotreating reaction conditions for the hydroprocessing zone may include a temperature from about 204° C. (400° F.) to about 482° C. (900° F.), a pressure from about 3.5 MPa (500 psig) to about 16.5 MPa (2400 psig), a liquid hourly space velocity of the fresh hydrocarbonaceous feedstock from about 0.1 $hr^{-1}$ to about 10 $hr^{-1}$ with a hydrotreating catalyst or a combination of hydrotreating catalysts. Other conditions may also be used depending on the specific feeds, catalysts, and composition of the effluent stream desired.

The hydrogen requirements for the substantially liquid-phase hydrotreating zone are substantially satisfied by the remaining hydrogen dissolved in the process flow directed to the hydrotreating zone after the preceding hydroprocessing stages, in the presence of suitable catalyst(s) that are primarily active for the removal of heteroatoms, such as sulfur and nitrogen, from the hydrocarbon feedstock. In another aspect, the hydrogen requirements for the substantially liquid-phase hydrotreating zone are substantially satisfied by the remaining hydrogen dissolved in the process flow plus an additional quantity of hydrogen, remaining in the gas phase, which minimally maintains the hydroprocessing zone effluent in two-phases to a subsequent hydroprocessing zone. In one such aspect, suitable hydrotreating catalysts for use in the present invention are conventional hydrotreating catalysts mentioned above.

They, for example, include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. In another aspect, more than one type of hydrotreating catalyst may be used in the same reaction vessel. In such aspect, the Group VIII metal is typically present in an amount ranging from about 2 to about 20 wt-%, preferably from about 4 to about 12 wt-%. The Group VI metal will typically be present in an amount ranging from about 1 to about 25 wt-%, preferably from about 2 to about 25 wt-%.

In another aspect, the substantially liquid-phase reaction zones may be, for example, hydrocracking zones. The operation and catalysts used in such substantially liquid phase hydrocracking zones are similar to those discussed above with respect to the substantially three-phase, trickle bed reaction zones.

DETAILED DESCRIPTION OF THE DRAWING

Turning to the FIGURE, an exemplary hydroprocessing method that eliminates the use of a recycle gas compressor and gains the efficiencies of a multi-stage method and apparatus is described in more detail. It will be appreciated by one skilled in the art that various features of the above described process, such as pumps, instrumentation, heat-exchange and recovery units, condensers, compressors, flash drums, feed tanks, and other ancillary or miscellaneous process equipment that are traditionally used in commercial embodiments of hydrocarbon conversion processes have not been described or illustrated. It will be understood that such accompanying equipment may be utilized in commercial embodiments of the flow schemes as described herein. Such ancillary or miscellaneous process equipment can be obtained and designed by one skilled in the art without undue experimentation.

With reference to the FIGURE, an integrated hydroprocessing unit 10 is illustrated where a hydrocarbonaceous feedstock, such as a vacuum gas oil or a heavy gas oil, is introduced into the process via a fresh hydrocarbonaceous feed line 12 and is separated into a first portion of fresh feed in a first hydrocarbonaceous portion line 14, a second portion of fresh feed in a second hydrocarbonaceous portion line 16, a third portion of fresh feed in a third hydrocarbonaceous portion line 18 and fourth portion of fresh feed in a fourth hydrocarbonaceous portion line 20. Lines 14, 16, 18 and 20 are all in downstream communication with the fresh hydrocarbonaceous feed line 12. The hydrocarbonaceous feedstock is provided at a first temperature which may be at a temperature well below reactor temperature such as a first temperature between about 200° and about 300° F. (90° and 150° C.) because the feedstock is not subjected to substantial heating and preferably not subjected to any heating.

A hydrogen-rich gaseous stream is provided via a hydrogen source such as line 22 via a make-up gas compressor 25. In an aspect, hydrogen in line 22 is only provided via a make-up gas compressor 25. Line 22 is in downstream communication with the make-up gas compressor 25. The hydrogen source 22 may be in downstream communication with a general refinery hydrogen supply. The hydrogen-rich gaseous stream from line 22 is admixed with the first portion of fresh feed in the first hydrocarbonaceous portion line 14 which is in downstream communication with the hydrogen line 22 to provide an admixture of the first portion of hydrocarbonaceous feedstock and hydrogen in line 15. The first portion of fresh feed is heated to the appropriate reaction temperature with a heater. The heater 17 may be one or more fired heaters and/or heat exchangers represented by fired heater 17. For example, the admixture of hydrogen and the first portion in line 15 may be heated in a fired heater 17 and/or a heat exchanger. Alternatively or additionally, the heater 17 may be located to heat the first portion of fresh feed upstream of line 15 in line 14. Alternatively or additionally, the hydrogen in line 22 may be heated by a heat exchanger 23 or other means and mixed with the first portion of fresh feed to thereby heat the first portion in line 15. Any combination of these arrangements may be appropriate to heat the first portion of fresh feed to a second temperature that is greater than the first temperature. Portions of fresh feed in lines 16, 18 and 20 bypass the heater 17 used to heat the first portion of fresh feed to keep the other portion of feed relatively cool.

The heated, combined stream in line 19 is introduced into the first, Stage I, hydroprocessing reaction zone comprising the hyroprocessing reactor 24. The first, Stage I, hydroprocessing reaction zone is in downstream communication with the first hydrocarbonaceous portion in lines 14, 15 and 19, the hydrogen line 22 and the heater 17 and/or 23. The hydroprocessing reactor 24 may be a single catalyst bed or may be a single vessel with one or more catalyst beds. As mentioned above, in one aspect this is a substantially three-phase, trickle bed hydroprocessing reactor, with the hydrogen requirement for the substantially three-phase reactor supplied from the combined stream of hydrogen from line 22 and fresh feed 14.

A first effluent stream is removed via a first hydroprocessed effluent line 26 from the Stage I hydroprocessing reactor 24. The first hydroprocessed effluent line 26 is in downstream communication with the second hydrocarbonaceous portion line 16. The first effluent stream is admixed with the unheated, second portion of fresh feed in second hydrocarbonaceous portion line 16 to quench the first effluent stream by absorbing some of the heat generated in the exothermic hydroprocessing reaction. As discussed above, the amount and rate of addition of the second portion of fresh feed will depend on the specific composition of the hydrocarbonaceous feed, the composition and hydrogen concentration and temperature of the first effluent. The combined and quenched first effluent and second portion of fresh feed 16 are introduced into to a second, Stage II, hydroprocessing reaction zone comprising second hydroprocessing reactor 28. Hydroprocessing reactor 28 may be a single catalyst bed or may be a single vessel with one or more catalyst beds. In one aspect, Stage II hydroprocessing reaction zone also is a substantially three-phase trickle bed reactor, with sufficient hydrogen in the combined first effluent and second portion of fresh feed 16 to satisfy the hydrogen requirements of the second substantially three-phase reactor 28.

A second effluent stream is removed via a second hydroprocessed effluent line 30 from the Stage II hydroprocessing reactor 28. The second hydroprocessed effluent line 30 is in downstream communication with the third hydrocarbonaceous portion line 18. The second effluent stream is admixed with the unheated, third portion of fresh feed in the third hydrocarbonaceous portion line 18 to quench the second effluent stream by absorbing some of the heat generated in the exothermic hydroprocessing reaction. As with the preceding stage, the amount and rate of addition of the third portion of fresh feed will depend on the specific composition of the hydrocarbonaceous feed, the composition and the hydrogen concentration and temperature of the second effluent. The combined and quenched second effluent and third portion of fresh feed 18 are introduced into to a third, Stage III, hydroprocessing reaction zone comprising third hydroprocessing reactor 32. Hydroprocessing reactor 32 may be a single catalyst bed or may be a single vessel with one or more catalyst beds.

Depending on the hydrogen content of the second effluent stream, as well as the desired reaction conditions, in one aspect the Stage III hydroprocessing reaction zone may be a substantially three-phase trickle bed reactor, with sufficient hydrogen in the combined second effluent and third portion of fresh feed 18 to satisfy the hydrogen requirements of a third substantially three-phase reactor. In many processes, the hydrogen content of the second effluent is insufficient to satisfy the hydrogen requirements of a substantially three-phase reactor, and thus the third, Stage III reactor 32 is a substantially liquid-phase reactor as mentioned above.

A third effluent stream is removed via a third hydroprocessed effluent line 34 from the Stage III hydroprocessing reactor 32. The third hydroprocessed effluent line 34 is in downstream communication with the fourth hydrocarbonaceous portion line 20. The third effluent stream in the third hydroprocessed effluent line 34 is admixed with the unheated, fourth portion of fresh feed 20 to quench the third effluent stream by absorbing some of the heat generated in the exothermic hydroprocessing reaction. As with the preceding stage, the amount and rate of addition of the fourth portion of fresh feed will depend on the specific composition of the hydrocarbonaceous feed, the composition and the hydrogen concentration and temperature of the third effluent. The combined and quenched third effluent and fourth portion of fresh feed 20 is introduced into to a fourth, Stage IV, hydroprocessing reaction zone, comprising a fourth hydroprocessing reactor 36. Hydroprocessing reactor 36 may be a single catalyst bed or may be a single vessel with one or more catalyst beds. In one aspect, the Stage IV hydroprocessing reaction zone also is a substantially liquid-phase reactor zone, with sufficient hydrogen in the third effluent and fourth portion of fresh feed 20 to satisfy the hydrogen requirements of the fourth, substantially liquid-phase reactor zone 36. In another aspect, the Stage IV hydroprocessing reaction zone also is a substantially liquid-phase bed reactor, with sufficient hydrogen in the third effluent and fourth portion of fresh feed 20 to satisfy the chemical hydrogen requirements of the fourth, substantially liquid-phase reactor 36 and an additional quantity of hydrogen as to minimally maintain the Stage IV effluent in two phases.

A final effluent stream is removed from the Stage IV hydroprocessing reactor 36 via line 38 and is transported via line 38 into a separation zone 40. A vaporous stream is removed from the separation zone 40 via line 42 and is further separated into a hydrogen rich stream, contaminants, such as hydrogen sulfide and ammonia, and low boiling point hydrocarbons. The hydrogen rich stream may be sent to a general refinery hydrogen supply, but is not recycled back to the hydroprocessing stages I-IV unless optionally recycled through a make-up gas compressor 25. Consequently, the hydrogen line 22 is out of downstream communication with said hydroprocessing stages I-IV but optionally through a make-up gas compressor 25. Moreover, the hydroprocessing stages I-IV are out of downstream communication with a recycle gas compressor. The remaining liquid phase is removed from the separation zone via line 44 and is directed to further processing or to a fractionation zone for further separation into its constituents.

An alternative embodiment is shown in phantom in the FIGURE. The remaining liquid phase is removed from the separation zone via 44 and, optionally, a portion of the liquid phase is externally recycled in line 46, such that the external recycle is added as a diluent as desired to one or more or all of the streams of fresh feed 14, 16, 18 and 20. In another aspect, the external recycle is added as a diluent entirely to the first portion of fresh feed 14. The remaining liquid phase from the separation zone 40 is directed by line 48 to further processing treatments and/or to a fraction zone for further separation into its constituents.

EXAMPLE

One example provided below illustrates aspects of the methods and apparatuses discussed above they may be applied to hydrotreating processes using trickle bed, substantially three phase reactors and substantially liquid phase reactors. The example provides data concerning the process flows, process flow temperatures, etc. based on a fresh feedstock rate and catalyst bed distributions, and process flow temperature increases based on a computer simulation developed from actual operating experiences with similar hydrotreating reactors and feedstocks. The feedstock in the example is a vacuum gas oil with the following properties: API Gravity=19.8, Distillation (ASTM D-1160) IBP=725° F. (385° C.), 10%=752° F. (400° C.), 30%=797° F. (425° C.), 50%=833° F. (445° C.), 70%=878° F. (470° C.), 90%=986° F. (530° C.), EP=1022° F. (550° C.) containing 3.5 wt-% Sulfur and 600 wppm total nitrogen. In the example the feedstock is hydrotreated to a product which would contain nominally between 1000 to 1500 wppm of sulfur.

In the example below, the data is reported in approximate values, i.e., approximate flow rates, temperatures, hydrogen contents and consumption, etc., and the values are be rounded to the nearest reported decimal place. The "Initial Feed Flow Rate" is the flow rate of the feedstock in barrels per day ("bpd") as the fresh feed is supplied to the unit and as divided into four process flows for the stages of the methods and apparatuses. The "Flow Rate, Outlet Of Processing Stage" is the flow rate of the hydroprocessed process flow from the respective hydroprocessing stage of the apparatus. The "Temp. Into Processing Stage" and "Temp. Out Of Processing Stage" are the temperatures of the process flow at the inlet and the outlet, respectively, of each process stage.

The "Ratio Of Initial Feed To Stage Effluent" is the calculated ratio of the hydroprocessed process flow from each process stage to portion of fresh feed added to the process flow for that stage, i.e., the previously hydroprocessed process flow rate divided by the added, fresh feed flow to each process stage.

The "Inlet Hydrogen/Liquid Phase" is the hydrogen content of the process flow at the inlet to each process stage divided by the total liquid charge into the process stage. The "Catalyst LHSVRC" reflects the volume of the catalyst supplied for the reaction stage in terms of the liquid volume per hour reactor charge per volume catalyst in the reaction stage.

In this example, the method and apparatus illustrated in one aspect in the FIGURE is adapted for use with a four catalyst bed hydrotreating unit with an approximate 331 $m^3$/hr (50,000 barrels per day) output. The feedstock is the vacuum gas oil described above. The first two catalyst beds provide a first and second stage, respectively, substantially three-phase, trickle bed hydrotreatment reaction zones and the third and fourth catalyst beds providing the third and fourth stage, respectively, substantially liquid-phase hydrotreatment reaction zones.

The feedstock is divided into four portions of fresh feed, with only the first portion of fresh feed (fresh feed to the first reaction zone/stage) receiving a flow of hydrogen to supply the hydrogen requirements for all four beds. Approximately 75 wt-% of the fresh feed is fed to the first stage. The remaining 25 wt-% of feed is split into three quench streams of approximately 8 wt-% of the total fresh feed each. The hydrogen flow is at 115 $Nm^3/m^3$ (682 SCF/bbl) based on the total fresh feed to the unit. As discussed above, second through fourth portions of the fresh feed are mixed with the effluent from their respective prior hydrotreatment reaction zone/stage. The projected process parameters for the feeds and each hydrotreatment reaction stage are shown below in the Table I.

TABLE I

| Stage | Initial Feed Flow Rate; bpd (m3/h) | Flow Rate, Outlet Of Processing Stage; bpd (m3/h) | Temp. Into Processing Stage; ° F. (° C.) | Temp. Out of Processing Stage; ° F. (° C.) | Ratio of Fresh Feed To Upstream Stage Effluent | Inlet Hydrogen/ Liquid Phase; scf/bbl (Nm3/m3) | Catalyst LHSVRC (l/hr) |
|---|---|---|---|---|---|---|---|
| Into Unit | 50,000 (331.3) | | | | | | |
| I | 36950 (244.8) | 36950 (244.8) | 660.7 (349.3) | 693.7 (367.6) | 0 | 923 (156) | 6.50 |
| II | 4300 (28.49) | 41250 (273.3) | 662.4 (350.2) | 693.7 (367.6) | 0.116 | 628 (106) | 3.63 |

TABLE I-continued

| Stage | Initial Feed Flow Rate; bpd (m3/h) | Flow Rate, Outlet Of Processing Stage; bpd (m3/h) | Temp. Into Processing Stage; ° F. (° C.) | Temp. Out of Processing Stage; ° F. (° C.) | Ratio of Fresh Feed To Upstream Stage Effluent | Inlet Hydrogen/ Liquid Phase; scf/bbl (Nm3/m3) | Catalyst LHSVRC (l/hr) |
|---|---|---|---|---|---|---|---|
| III | 4350 (28.82) | 45600 (302.1) | 664.1 (351.2) | 693.7 (367.6) | 0.106 | 388 (65.4) | 2.68 |
| IV | 4400 (29.15) | 50000 (331.3) | 665.7 (352.1) | 693.7 (367.6) | 0.096 | 190 (32.0) | 2.20 |
| Final Output | 50000 (331.3) | 50,000 (331.3) | | 693.7 (367.6) | | 26 (4.4) | |

As can be seen from the above, the method and apparatus provides an efficient hydroprocessing treatment without the need for the expense and complications of a hydrogen recycle compressor or supply of hydrogen recycle gas. Furthermore, the apparatus may be operated with a single hydrogen input in the feed to the first process stage, without the requiring additional hydrogen feeds to supply the subsequent processing stages. The apparatus also permits the use of substantially three-phase, trickle bed reactors and substantially liquid-phase reactors in a combined apparatus to provide the benefits offered by both types of catalyst/reactor apparatuses. The ratio of processed product out of each stage to the amount of fresh feed added to the process flow, in such aspects, may be in the range of about 3 to 1 or 5 to 1 or greater. The ratio of the amount of fresh feed added to the amount of process flow out of each stage may be in the range of 1 or less, typically 0.5 or less and preferably 0.2 or less.

As also can be seen from the above example, the above mentioned benefits may be obtained, while so providing temperature control over the catalyst beds. Thus, the temperature of the process flow may be modified to ensure that the temperature over the catalyst beds do not exceed the maximum temperatures for the efficient operation of the catalyst beds.

The foregoing description of the drawing and examples clearly illustrate the advantages encompassed by the processes described herein and the benefits to be afforded with the use thereof. In addition, the FIGURE and the above examples are intended to illustrate exemplary flows scheme and conditions of the methods and apparatus described herein, and other flow schemes, methods and apparatuses are also possible, are not intended as limits to the methods and apparatus. It will be further understood that various changes in the details, materials, and arrangements of conditions, compositions, parts and components which have been herein described and illustrated in order to explain the nature of the process may be made by those skilled in the art within the principle and scope of the methods and apparatus as expressed in the appended claims.

The invention claimed is:

1. A method of processing a hydrocarbonaceous feedstock having a predetermined entering flow rate comprising the steps of:

providing two or more hydroprocessing stages disposed in sequence and in fluid communication, each hydroprocessing stage having a hydroprocessing reaction zone with a hydrogen requirement and each stage disposed to receive a process flow and to produce a hydroprocessed effluent;

providing hydrogen only through a make-up gas compressor;

providing the hydrocarbonaceous feedstock at a first temperature;

separating the hydrocarbonaceous feedstock flow into a first portion of fresh feed for a first hydroprocessing stage and a second portion of fresh feed for a second hydroprocessing stage;

heating the first portion of fresh feed to a second temperature that is greater than the first temperature;

supplying the first portion of fresh feed with hydrogen from the hydrogen source in an amount sufficient to satisfy all gas requirements of all the hydroprocessing stages;

passing the heated, hydrogen enriched first portion of fresh feed as a process flow through the first hydroprocessing stage to form a hydroprocessed effluent wherein the volume of the hydroprocessed effluent exceeds the volume of the second portion of fresh feed;

quenching a hydroprocessed effluent of a preceding hydroprocessing stage with the unheated second portion of fresh feed; and passing a process flow including the hydroprocessed effluent of the preceding hydroprocessing stage quenched with the second portion of fresh feed to the second hydroprocessing stage, the hydrogen requirement for second hydroprocessing stage supplied from the process flow into the second hydroprocessing stage.

2. The method of claim 1 wherein the temperature of the fresh feed for the second hydroprocessing stage is less than the temperature of the effluent from the preceding hydroprocessing stage.

3. The method of claim 1 wherein the hydroprocessing stages are three-phase reaction zones.

4. The method of claim 1 wherein each hydroprocessing zone of each hydroprocessing stage is supplied with at least one catalyst bed having a catalyst volume, the catalyst volume increasing in each subsequent hydroprocessing stage.

5. The method of claim 1 further including heating the first portion of fresh feed in a heater and bypassing the second portion of fresh feed around the heater.

6. The method of claim 1 wherein the first portion of fresh feed is heated by heating hydrogen supplied to the first portion of fresh feed from a hydrogen source.

7. The method of claim 1 wherein one or more hydroprocessing stages are hydrotreating stages followed by one or more hydroprocessing stages subjecting the process flow to conversion reactions.

8. The method of claim 1, further comprising separating the effluent from a final hydroprocessing stage into a substantially vapor stream and a substantially liquid stream.

9. The method of claim 8 wherein a portion of the liquid stream is recycled and introduced into the first portion of fresh feed as a diluent, and the volume of the effluent from the final hydroprocessing stage is approximately the same as the total of the hydrocarbonaceous feedstock volume and the diluent volume.

10. A method of processing a hydrocarbonaceous feedstock flow having a predetermined entering flow rate comprising the steps of:

providing at least a first hydroprocessing reaction zone with a first hydrogen requirement and at least a second hydroprocessing zone with a second hydrogen requirement, the first and second reaction zones in fluid communication;

providing the hydrocarbonaceous feedstock at a first temperature;

providing hydrogen only through a make-up gas compressor;

separating the hydrocarbonaceous feedstock flow into portions of fresh feed for each hydroprocessing reaction zone, a first portion of fresh feed supplied with hydrogen from the hydrogen supply in an amount satisfying all gas requirements of at least each hydroprocessing reaction zone;

heating the first portion of fresh feed to a second temperature that is greater than the first temperature;

passing the heated, hydrogen enriched first portion of fresh feed through the first hydroprocessing zone to form a first hydroprocessed effluent; and quenching the first hydroprocessed effluent of the first hydroprocessing zone with an unheated, second portion of fresh feed, the volume of the first hydroprocessed effluent exceeding the volume of the second portion of fresh feed;

the combined first hydroprocessed effluent and second portion of fresh feed passed into the second hydroprocessing zone to form a second hydroprocessed effluent, the second hydrogen requirement supplied from the combined first effluent and second portion of fresh feed.

11. The method of claim 10 further including heating the first portion of fresh feed in a heater and bypassing the second portion of fresh feed around the heater.

12. The method of claim 10 wherein the first portion of fresh feed is heated by heating hydrogen supplied to the first portion of fresh feed from a hydrogen source.

13. The method of claim 10 wherein the hydroprocessing stages are substantially liquid phase reaction zones.

14. A method of processing a hydrocarbonaceous feedstock having a predetermined entering flow rate comprising the steps of:

providing two or more hydroprocessing stages disposed in sequence and in fluid communication, each hydroprocessing stage having a hydroprocessing reaction zone with a hydrogen requirement and each stage disposed to receive a process flow and to produce a hydroprocessed effluent;

providing a hydrogen source;

providing the hydrocarbonaceous feedstock at a first temperature;

separating the hydrocarbonaceous feedstock flow into a first portion of fresh feed for a first hydroprocessing stage and a second portion of fresh feed for a second hydroprocessing stage;

heating the first portion of fresh feed to a second temperature that is greater than the first temperature;

supplying the first portion of fresh feed with hydrogen from the hydrogen source in an amount sufficient to satisfy all gas requirements of all the hydroprocessing stages;

passing the heated, hydrogen enriched first portion of fresh feed as a process flow through the first hydroprocessing stage to form a hydroprocessed effluent;

quenching a hydroprocessed effluent of a preceding hydroprocessing stage with the unheated second portion of fresh feed, the volume of the hydroprocessed effluent exceeding the volume of the second portion of fresh feed; and passing a process flow including the hydroprocessed effluent of the preceding hydroprocessing stage quenched with the second portion of fresh feed to the second hydroprocessing stage, the hydrogen requirement for second hydroprocessing stage supplied from the process flow into the second hydroprocessing stage.

15. The method of claim 14 wherein the hydroprocessing stages are three-phase reaction zones.

16. The method of claim 14 wherein the final flow rate of the effluent from the last hydroprocessing stage approximately same as the entering feedstock flow rate.

17. The method of claim 14 further including heating the first portion of fresh feed in a heater and bypassing the second portion of fresh feed around the heater.

18. The method of claim 14 wherein the first portion of fresh feed is heated by heating hydrogen supplied to the first portion of fresh feed from a hydrogen source.

* * * * *